US005722490A

United States Patent [19]

Ebinger

[11] Patent Number: 5,722,490

[45] Date of Patent: Mar. 3, 1998

[54] METHOD OF COMPLETING AND HYDRAULIC FRACTURING OF A WELL

[75] Inventor: Charles D. Ebinger, Lafayette, La.

[73] Assignee: Ely and Associates, Inc., Houston, Tex.

[21] Appl. No.: 575,290

[22] Filed: Dec. 20, 1995

[51] Int. Cl.[6] ..... E21B 43/267

[52] U.S. Cl. ..... 166/281; 166/308

[58] Field of Search ..... 166/281, 278, 166/308

[56] References Cited

U.S. PATENT DOCUMENTS

| | | | |
|---|---|---|---|
| 2,753,940 | 7/1956 | Bonner | 166/308 |
| 4,253,522 | 3/1981 | Setterberg | 166/278 |
| 4,372,384 | 2/1983 | Kinney | 166/278 |
| 4,685,519 | 8/1987 | Stowe | 166/278 |
| 4,969,524 | 11/1990 | Whiteley | 166/278 |
| 5,062,484 | 11/1991 | Schroeder, Jr. et al. | 166/278 |
| 5,174,379 | 12/1992 | Whiteley | 166/278 |
| 5,332,038 | 7/1994 | Tapp | 166/278 |
| 5,435,391 | 7/1995 | Jones | 166/278 |
| 5,443,117 | 8/1995 | Ross | 166/51 |
| 5,598,891 | 2/1997 | Snider et al. | 166/308 |

OTHER PUBLICATIONS

Ebinger, C.D., "Frac pack technology still evolving," *Oil & Gas Journal*, Oct. 23, 1995, pp. 60–70.

Roodhart, L.P. et al., "Fac and Pack Stimulation: Application, Design, and Field Experience From the Gulf of Mexico to Borneo," SPE 26564, 68th Annual Technical Conference, Houston, Texas, Oct. 3–6, 1993, pp.507–518.

Wong, G.K. et al, "Design, Execution, and Evaluation of Frac and Pack (F&P) Treatments in Unconsolidated Sand Formations in the Gulf of Mexico," SPE 26563, 68th Annual Technical Conference, Houston, Texas, Oct. 3–6, 1993, pp. 491–506.

Penberthy, W L, Jr and C M Shaughnessy,m *Sand Control*, Chpt. 8, pp. 45–57, 1992.

*Primary Examiner*—Hoang C. Dang

*Attorney, Agent, or Firm*—Hutcheson & Grundy, L.L.P.

[57] ABSTRACT

A method for completing and increasing the production rate from a cased well which may produce solids through perforations during production is provided. A gravel pack screen is placed in the well along with equipment in the tubing string to control flow from inside to outside the tubing below a production packer. The rig used to place the equipment may then be released from the well. The well is then hydraulically fractured. If the well is producing from a high permeability zone, the hydraulic fracture is preferably formed with the tip screen-out technique. The method can also be used in a well already containing production tubing without moving a rig on the well to remove the tubing from the well and can be used in a well not yet perforated by adding tubing-conveyed perforating apparatus below the screen.

10 Claims, 2 Drawing Sheets

METHOD OF COMPLETING AND HYDRAULIC FRACTURING OF A WELL

BACKGROUND OF THE INVENTION

1. Field of the Invention

This invention relates to completing and hydraulic fracturing a well. More particularly, a method is provided for fracturing a well with a well screen in place and subsequently completing the well to commence production without the need for a drilling or workover rig on the well.

2. Description of the Prior Art

The use of "Frac Pack" procedures in wells has increased rapidly in recent years. These procedures were recently reviewed ("Frac Pack technology still evolving," C. D. Ebinger, *Oil and Gas Journal*, Oct. 23, 1995). In the Frac Pack, a well is hydraulically fractured, such that any damage to flow in the near wellbore region is removed by the fracturing treatment, and at the same time the well is provided with means for controlling flow of formation sand into the wellbore during production of the well. A gravel screen is normally placed in a well just as in a conventional gravel pack of a well to serve as the means to control flow of solids into the well. There have been two basic techniques used: a one-step procedure and a two-step procedure. Most treatments to date have used the one-step procedure.

In the one-step procedure, a well is perforated and a conventional gravel pack assembly, normally providing a cross-over of fluids from the work string to the annulus, is run into the well. The conventional cross-over gravel-pack equipment includes a service tool, a gravel pack packer, a ported housing and port closure sleeve, sealbore housings, check valve, a wash pipe extending through the screen, a lower seal assembly and a sump packer. The hydraulic fracturing treatment is then pumped through the conventional gravel-parting equipment. The equipment may be modified by increasing the size of ports through which the fluids and proppant flow. If the fracturing treatment is being performed in a relatively high permeability reservoir, the "tip screenout" process may be applied, using techniques described in "Tip Screenout Fracturing: A technique for Soft Unstable Formations," *Production Engineering*, Soc. of Pet Engrs., May, 1987, pp. 95–103. With this process, pressure of pumping increases toward the end of the treatment and proppant is pumped at high concentrations in the fracturing fluid to create a wide, proppant-parted fracture near the wellbore. Excess proppant left in the well is then reversed out. In many wells which are hydraulically fractured, there is no need to control production of formation sand into the well and a gravel pack screen is never placed in the well.

In the two-step procedure, the hydraulic fracturing treatment, which may employ a "tip screen out" procedure, is pumped through a work string with a squeeze packer set at the bottom of the string. A bypass port in the squeeze packer is then opened and excess proppant is reversed out by pumping down the annulus outside the work string. Solids are then washed from the well and a gravel pack screen and blank pipe is then run into the well. A conventional high-rate gravel pack is then conducted using water or low-viscosity polymer solutions in water.

In the one-step procedure outlined above, a drilling or workover rig must be present on the well until after the hydraulic fracturing treatment has been performed on the well. The rig is then required to remove equipment which has been used to run and manipulate the gravel pack screen and associated flow control valves. In the two-step procedure, the rig is required until the gravel pack operation is complete.

In some wells having small perforated intervals, a gravel pack screen is not used and Frac Packs have been performed using curable resin-coated proppant or proppant containing fibers to prevent flow-back of proppant. These procedures are limited to short perforated intervals, however, and are not applicable in many wells. Even in wells where they are used it is normal to have a wireline and coiled tubing unit at the well site for cleaning out excess proppant, if necessary.

In offshore operations, it is particularly expensive to maintain a rig on the well while completion or workover operations are performed. There is a need, both in onshore and offshore wells, for procedures which achieve the results from hydraulic fracturing and sand control in the well and which require less rig time on the well. Also, there is a need for procedures which can reduce auxiliary costs such as for completion fluid in high pressure wells and which allow pressure or production testing of wells after the rig on the well has been released. Simpler equipment and less equipment, which means lower cost equipment, is needed than the conventional gravel packing assembly and associated running tools required to place the equipment in the well.

SUMMARY OF THE INVENTION

The present invention provides a method for hydraulic fracturing a well after a screen assembly has been placed in the well and the rig has been removed from the well. After production casing has been run into a well and cemented, a rig is used to place a gravel pack screen, sand filling the screen and any blank pipe above the screen or a removable tubing plug, a port in the tubing (above the sand or plug) which can be opened and closed by wireline or coiled tubing, and a production packer in the well, all attached on the lower end of the tubing string. If the casing in the well has not been perforated into the productive zone, tubing-conveyed perforating apparatus may be placed below the gravel pack screen and activated as a first step. After the production packer is set and the packer tested, the tubing port is opened and a hydraulic fracturing treatment is pumped through the tubing port. Coiled tubing is then used to wash out proppant left in the tubing and the sand placed in the screen, so as to remove the tubing plug, the tubing port is closed and the well is ready to be tested or produced. The same procedures can be used in wells completed in multiple zones by repeating these steps in each zone.

In another embodiment, a screen assembly is placed in a well which contains production tubing. A through-tubing gravel pack screen is connected through blank pipe with a vent screen to form a closed cylinder screen assembly that can be run through the tubing. The wall is then fractured down the production tubing and around the screen assembly below the tubing. Proppant left in the well is washed out down to below the vent screen. The blank pipe is long enough to separate the vent screen and gravel pack screen far enough such that the pressure drop through the proppant left in the casing above the gravel pack screen and outside the blank pipe is much greater than the pressure drop through the interior of the closed cylinder consisting of the screen on each end of blank pipe. This causes the flow coming through perforations to flow through the gravel pack screen, up the blank pipe, out the vent screen and through the tubing to surface.

DETAILED DESCRIPTION OF THE INVENTION

Figure 1:
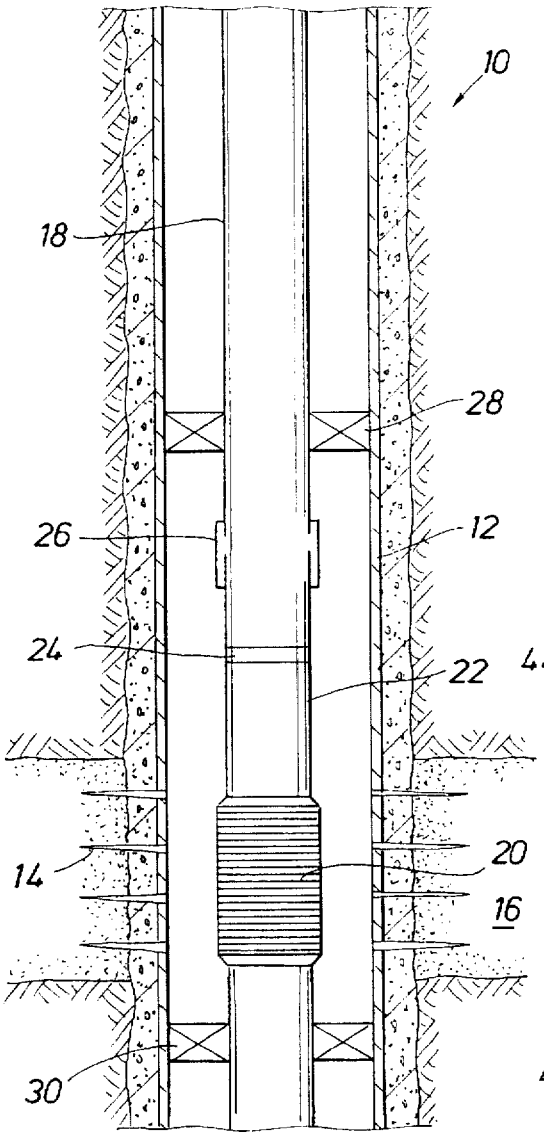
FIG. 1 shows a well perforated in a single productive zone having tubing, packers, a screen placed in the well on the tubing and equipment suitable for practicing an embodiment of the invention.

Referring to FIG. 1, well 10 contains casing 12. Perforations 14 have been formed in the casing opposite productive zone 16. Tubing string 18 has been placed in the well and may be snapped into sump packer 30 which may be previously placed in the well. Sump packer 30 is used to isolate production from zone 16 from lower perforated zones, if any, in the well. Pre-packed screen 20, blank pipe 22, punch out or isolation plug 24 and closing sleeve 26 and hydraulic packer 28 are assembled on tubing string 18 at desired spacing distances before the equipment and tubing string are placed in the well using conventional rig techniques. Closing sleeve 26 is preferably placed in the open position. Plug 24 may be replaced with sand which is placed inside blank pipe 22 and screen 20 before the equipment is placed in the well (see FIG. 4). The equipment called-for is well-known in the art of well completions. Closing sleeve 26 is available from Otis Division of Halliburton Company or other sources. Ports of the sleeve are preferably large enough for passage of high concentrations of proppant as large as 10-mesh. Pre-packed screen 20 may be obtained from Johnson Screen Company, Houston Screen Company or from several other sources. Alternatively, screen 20 may be a wire-wrapped screen, also available from a number of sources in industry. The equipment is run into the well on tubing string 18 with closing sleeve 26 preferably in the open position. Packer 28 is then set, either by hydraulic or mechanical procedures well-known in industry. Packer 28 may be obtained from Schlumberger Dowell or from other sources. Formation 16 is then isolated from flow outside tubing string 18. The rig on the well can then be moved off the well site.

A coiled tubing unit and hydraulic fracturing equipment are then moved on the well. A wire line is used to open closing sleeve 26, if necessary. A hydraulic fracturing treatment is then performed down tubing string 18. If the productive zone is a high permeability and soft formation, the hydraulic fracturing treatment preferably employs the "tip screen-out" technique, which means that high concentrations of proppant are pumped near the end of the treatment. For any fracturing treatment, proppant may be left in the tubing. After the fracturing treatment, coiled tubing having a closing tool on bottom is run into the well to wash out proppant left in the tubing and the sand which was placed in the blank pipe and gravel pack screen at the surface. Alternatively, the coiled tubing is used to remove the tubing plug from isolation plug 24. The plug may be pushed down through packer 30, which may contain a seal assembly. The closing tool on the coiled tubing is then used to close sleeve 26. The well may then be pressure tested, production tested or placed on production.

Figure 2:
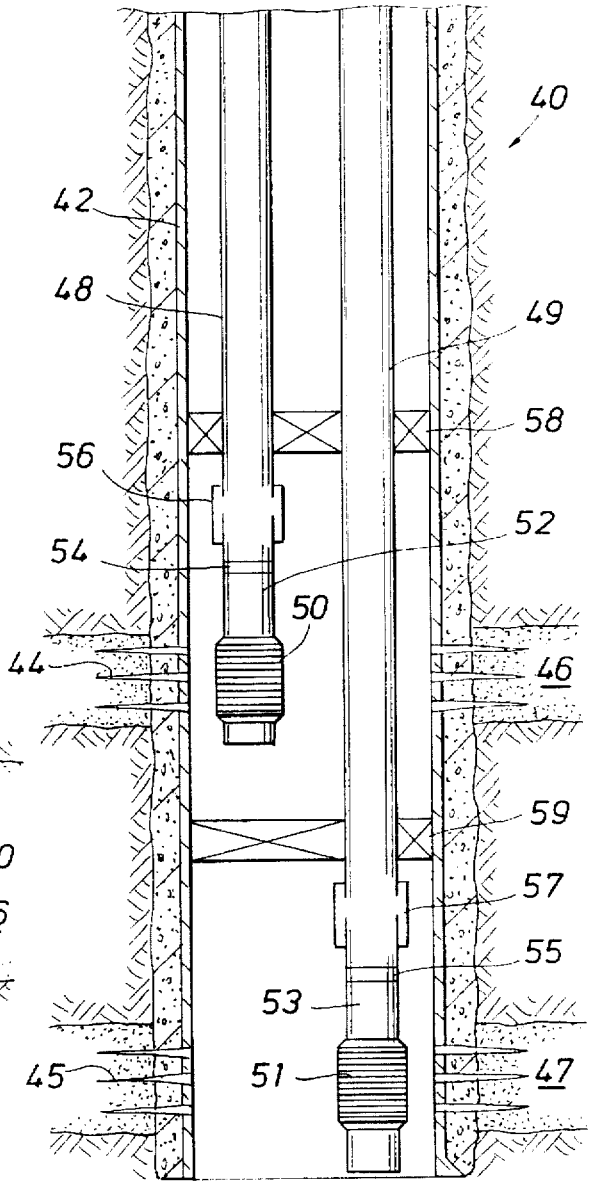
FIG. 2 shows a well perforated in two productive zones and having dual tubing strings, packers, screens placed in the well on the tubing strings and equipment suitable for practicing an embodiment of the invention.
Figure 4:
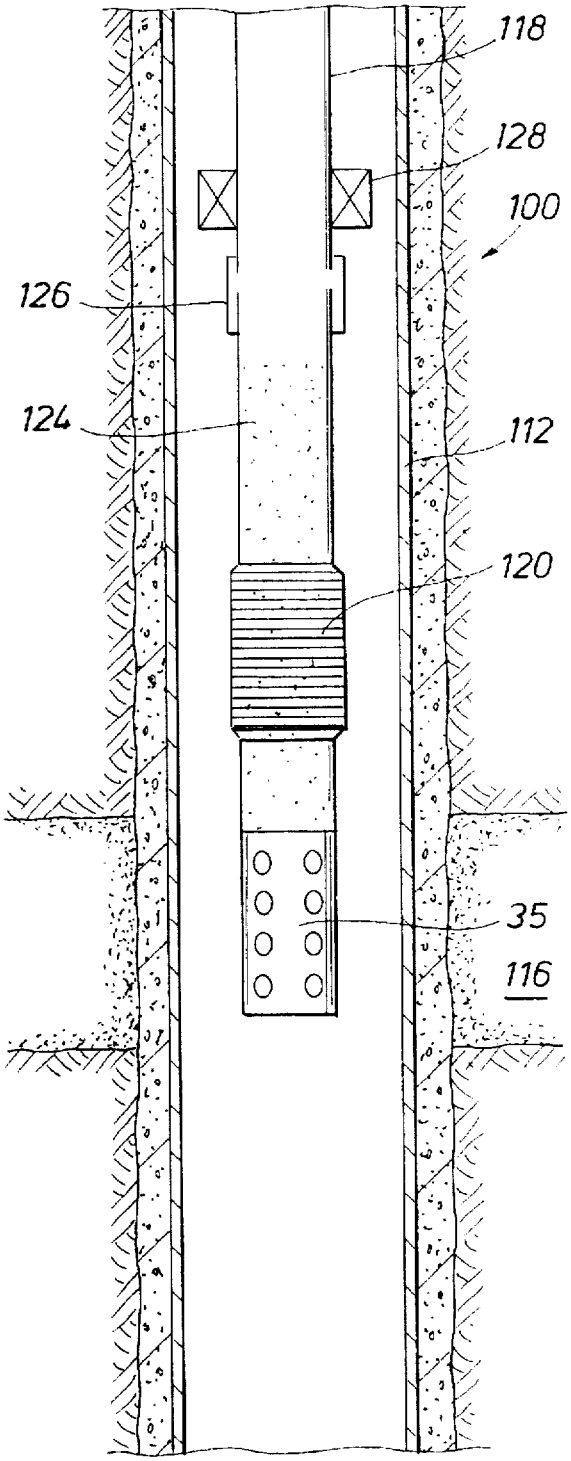
FIG. 4 shows a well to be perforated in a single productive zone having tubing, a packer to be set, screen placed in the well on the tubing and equipment suitable for practicing an embodiment of the invention.

Alternatively, the procedure described for the completion of FIG. 1 may be applied to multiple completed zones in a well. FIG. 2 shows such a completion in well 40. Casing 42 is cemented in the well and has been perforated with two sets of perforations, 44 and 45. Tubing strings 48 and 49 have been placed in the well. Well 40 penetrates two productive zones—46 (upper zone) and 47 (lower zone). Screens 50 and 51, blank pipe sections 52 and 53, tubing plugs 54 and 55, closing ports or closing sleeves 56 and 57, and hydraulically set packers 58 and 59 are assembled on tubing strings 48 and 49 before they are placed in the well using a rig. Alternatively, tubing plugs 54 and 55 are replaced by sand which is placed inside blank pipe sections 52 and 53 and screens 50 and 51 before the equipment is placed in a well, as shown in FIG. 4.

The rig is removed from the well site and a hydraulic fracturing treatment is then performed through each of the tubing strings and the same procedures as previously described are used to prepare each of the multiple productive zones of the well for testing and production.

The procedures described above apply to wells which do not contain tubing when a screen is to be placed in the well. In wells that have previously been produced, tubing will normally be present in the well. If the well is producing from an unconsolidated productive zone, the well may produce solids (sand) which accumulate in the wellbore and decrease or prevent production from the well. It is normal practice to begin workover operations of such a well by washing out the accumulated sand from inside the wellbore. This may be done with coiled tubing without removing the production tubing from the well and without requiring a rig on the well.

Figure 3:
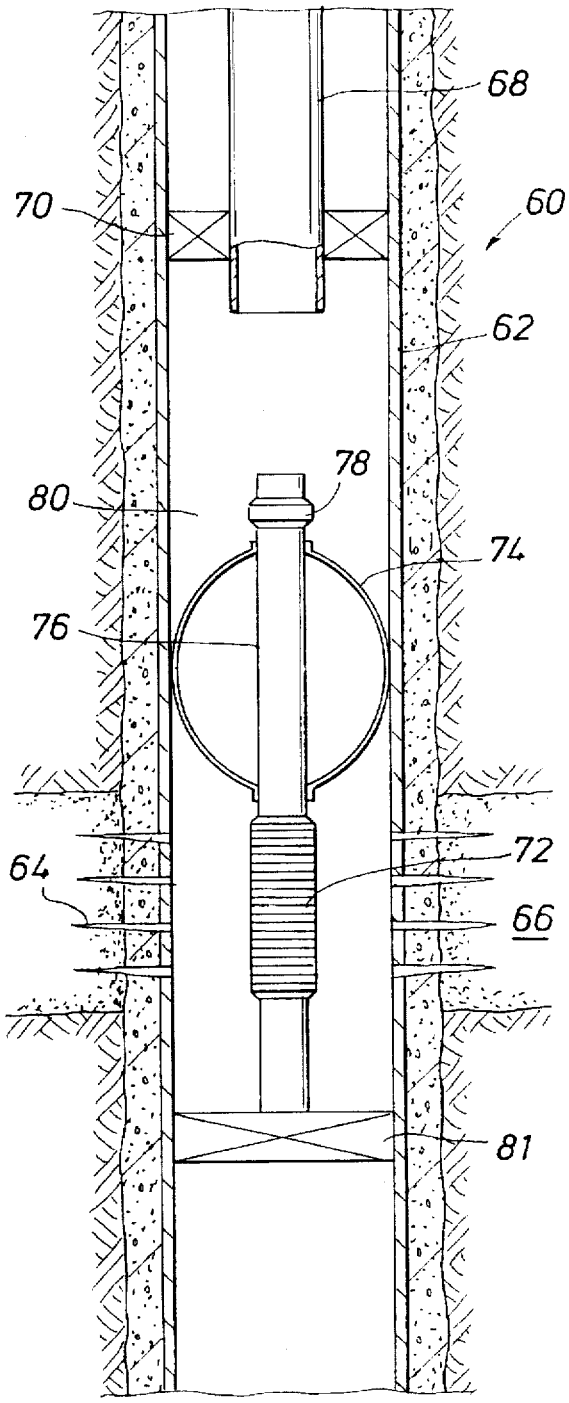
FIG. 3 shows a well perforated in a single productive zone having tubing, packers and a screen assembly placed in the well through the tubing.

Well screens are available in diameters small enough to be run through most sizes of production tubing. FIG. 3 illustrates a method for hydraulic fracturing or Frac Packing a well containing production tubing and producing it through a screen. In this method, equipment has been placed in well 60 which has casing 62 and tubing 68. Perforations 64 have been formed in the casing opposite productive zone 66. Tubing string 68 and production packer 70 are present in the well when the method of this invention is initiated.

Bottomhole screen assembly 80 is placed in well 60 through tubing 68, preferably by coiled tubing, and released from the coiled tubing, which is removed from the well. Before placing assembly 80 in the well, the casing is washed out or filled to a required plug back total depth such that screen 72 will be placed opposite existing perforations. Bottomhole assembly 80 may be supported in the well by plug 81. Bottomhole screen assembly 80 is comprised of screen 72, which is closed at the bottom or distal end of the screen, preferably a bow centralizer such as centralizer 74, blank pipe 76, and vent screen 78. Blank pipe (not shown) may be placed above vent screen 78. The top and bottom of assembly 80 are closed. The outside diameter of screens 72 and 78 are sized so as to run through production tubing 68. Bow centralizers are selected to contract sufficiently to allow assembly 80 to run through tubing 68 and to expand to centralize assembly 80 in casing 62. Such bow centralizers are known in industry. Screen 72 is selected to be a length to cover all perforations 64 when placed in a selected depth in the well.

The well is then hydraulically fractured or Frac Packed by pumping down production tubing 68. Fracturing fluid and proppant exit tubing string 68 and passes outside screen assembly 80 and through perforations 64. After completion of the fracturing treatment, preferably after tip screen-out of the treatment, proppant is washed from the well down to below vent screen 78, using coiled tubing. The well is then placed on production. Flow enters the wellbore through perforations 64, passes through from outside to inside of screen 72 and passes upward through the closed cylinder consisting of screen 72, blank pipe 76 and vent screen 78. Proppant left in the annulus outside blank pipe 76 prevents flow in the annulus between blank pipe 76 and casing 62, as flow resistance is much greater in the annulus than inside screen assembly 80. The length of blank pipe 76 is selected to insure that flow resistance through the proppant-filled annulus is many times the flow resistance from the perforations to the outside diameter of screen 72. Preferably, blank pipe 76 is at least 30 feet in length. The hydraulic fracture treatment or Frac Pack of the well is thus achieved without use of a rig on the well site and without removing production tubing 68 from the well.

In the embodiments described heretofore, the casing is perforated when the running of tubing into the well commences. In another embodiment of this invention, the casing is perforated by a perforating assembly which is attached below the gravel pack screen. Such tubing-conveyed perforating (TCP) assemblies are well-known in the art of well perforating, and are available from Halliburton Company and other sources. Referring to FIG. 4, perforating assembly 35 is first lowered on tubing string 118 to a depth opposite productive zone 116 and activated. Perforating assembly 35 may be designed to release from the tubing and fall to the bottom of the well at this time. Tubing string 118 is then lowered to place gravel pack screen 120 opposite at least one of the perforations formed, and preferably opposite all perforations formed. Packer 128 is then set, sleeve 126 is opened and zone 116 is hydraulically fractured. Proppant left in the tubing is washed out by coiled tubing and tubing plug 124 is removed. The well is then ready for testing or production.

This procedure using tubing-conveyed perforating assemblies may be applied when the well is to be completed in multiple zones. In this case the perforating guns on the shorter tubing string are oriented so as not to perforate the longer string.

While certain preferred embodiments of the invention have been described, numerous changes in the steps described may be made by those skilled in the art which are encompassed within the scope and spirit of the present invention as defined in the appended claims.

What is claimed is:

1. A method for completing a well and hydraulically fracturing a productive zone penetrated by the well, the well having casing, the casing having perforations into the productive zone, comprising the steps of:

(a) placing in the casing a tubing string, a gravel pack screen, the screen being placed opposite the perforations in the casing, means for temporarily plugging flow from the tubing to inside the screen, a controllable tubing port above the means for plugging and a tubing packer, the packer being above the port;

(b) setting the packer;

(c) hydraulically fracturing the wall by pumping fluid and proppant down the tubing string and through the port;

(d) removing the means for temporarily plugging flow from the tubing to inside the screen; and (e) adjusting the controllable tubing port so as to seal flow from inside to outside the tubing.

2. The method of claim 1 wherein the means for temporarily plugging flow from the tubing to inside the screen is sand which is placed inside the blank pipe and screen before plating the blank pipe and screen in the well.

3. The method of claim 1 wherein the means for temporarily plugging flow from the tubing to inside the screen is a punch-out or retrievable plug.

4. The method of claim 1 wherein the gravel pack screen is a pre-packed screen.

5. The method of claim 1 additionally comprising the step of placing a sump packer below the screen and setting the packer before step (c).

6. The method of claim 1 wherein steps (a) through (e) are repeated for two or more productive zones penetrated by the well.

7. A method for completing a well and hydraulically fracturing a productive zone penetrated by the well, the well having casing, comprising the steps of:

(a) placing in the casing a tubing string, a tubing-conveyed perforating assembly, a gravel pack screen, means for temporarily plugging flow from the tubing to inside the screen, a controllable tubing port above the means for plugging and a tubing packer, the packer being above the port;

(b) activating the perforating assembly to form perforations in the casing opposite a segment of the productive zone;

(c) lowering the tubing string so as to place the gravel pack screen opposite the perforations formed by the perforating assembly;

(d) setting the packer;

(e) hydraulically fracturing the well by pumping fluid and proppant down the tubing string and through the port;

(f) removing the means for temporarily plugging flow from the tubing to inside the screen; and (g) adjusting the port so as to seal flow from inside to outside the tubing.

8. The method of claim 7 wherein the means for temporarily plugging flow from the tubing to inside the screen is sand which is placed inside the blank pipe and screen before placing the blank pipe and screen in the well.

9. The method of claim 7 wherein the means for temporarily plugging flow from the tubing to inside the screen is a punch-out or retrievable plug.

10. The method of claim 7 wherein the gravel pack screen is a pre-packed screen.

* * * * *